US007201620B2

(12) United States Patent
Kinoshita et al.

(10) Patent No.: US 7,201,620 B2
(45) Date of Patent: Apr. 10, 2007

(54) OPERATION CONTROL SYSTEM FOR PLANING BOAT

(75) Inventors: Yoshimasa Kinoshita, Shizuoka-ken (JP); Sumihiro Takashima, Shizuoka-ken (JP); Shu Akuzawa, Shizuoka-ken (JP); Kazumasa Ito, Shizuoka-ken (JP); Toshiyuki Hattori, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/336,711

(22) Filed: Jan. 20, 2006

(65) Prior Publication Data

US 2006/0160438 A1 Jul. 20, 2006

(30) Foreign Application Priority Data

Jan. 20, 2005 (JP) ..... 2005-012847

(51) Int. Cl.
*B63H 21/22* (2006.01)

(52) U.S. Cl. ..... 440/1; 440/87

(58) Field of Classification Search ..... 440/1, 440/87

See application file for complete search history.

(56) References Cited

U.S. PATENT DOCUMENTS 3,183,879 A 5/1965 Heidner
4,423,630 A 1/1984 Morrison
4,445,473 A 5/1984 Matsumoto
4,492,195 A 1/1985 Takahashi et al.
4,556,005 A 12/1985 Jackson
4,767,363 A 8/1988 Uchida et al.
4,949,662 A 8/1990 Kobayashi
4,961,396 A 10/1990 Sasagawa
4,971,584 A 11/1990 Inoue et al.
4,972,792 A 11/1990 Yokoyama et al.
4,989,533 A 2/1991 Horiuchi
5,094,182 A 3/1992 Simner
5,113,777 A 5/1992 Kobayashi (Continued)

FOREIGN PATENT DOCUMENTS

CA 2271332 2/2000

(Continued)

OTHER PUBLICATIONS

Co-Pending U.S. Appl. No. 11/083,290 filed Mar. 17, 2005. Now published as U.S. 2006-0160440A1 (submitted herewith). Title: Engine Control Device. Inventor: Ishida et al.

(Continued)

*Primary Examiner*—Stephen Avila
(74) *Attorney, Agent, or Firm*—Knobbe, Martens, Olson & Bear, LLP

(57) ABSTRACT

An operation control system for a planing boat can include a mode selection module configured to allow a driver to select a driving mode of either one of a normal operation mode, in which the boat cruises at a speed in response to the displacement of an acceleration controller, and a speed-fixing mode, in which the boat cruises at a fixed speed at a level when a speed-fixing controller is operated. The system can also include a planing condition determination module configured to determine whether a hull is at the stage of planing, in which the mode selection module is configured to prohibit the driving mode from switching to the speed-fixing mode if the planing condition determination module determines that the hull is not at the stage of planning. The mode selection module can also be configured to permit the driving mode to switch to the speed-fixing mode if the planing condition determination module determines that the hull is at the stage of planing.

20 Claims, 9 Drawing Sheets

U.S. PATENT DOCUMENTS 5,118,315 A * 6/1992 Funami et al. ..... 440/1
5,144,300 A 9/1992 Kanno
5,167,547 A 12/1992 Kobayashi et al.
5,169,348 A * 12/1992 Ogiwara et al. ..... 440/1
5,184,589 A 2/1993 Nonaka
5,199,261 A 4/1993 Baker
5,203,727 A 4/1993 Fukui
5,244,425 A 9/1993 Tasaki et al.
5,350,325 A 9/1994 Nanami
5,352,138 A 10/1994 Kanno
5,366,394 A * 11/1994 Kanno ..... 440/2
5,367,970 A 11/1994 Beauchamp et al.
5,408,948 A * 4/1995 Arii et al. ..... 114/274
5,429,533 A 7/1995 Kobayashi et al.
5,474,007 A 12/1995 Kobayashi
5,520,133 A 5/1996 Wiegert
5,538,449 A 7/1996 Richard
5,591,057 A 1/1997 Dai et al.
5,603,644 A * 2/1997 Kobayashi et al. ..... 440/86
5,665,025 A 9/1997 Katoh
5,687,694 A 11/1997 Kanno
5,697,317 A 12/1997 Pereira
5,707,264 A 1/1998 Kobayashi et al.
5,713,297 A 2/1998 Tani et al.
5,839,700 A 11/1998 Nedderman, Jr.
5,904,604 A 5/1999 Suzuki et al.
5,908,006 A 6/1999 Ibata
5,941,188 A * 8/1999 Takashima ..... 114/55.5
5,988,091 A 11/1999 Willis
6,032,605 A 3/2000 Takashima
6,032,653 A 3/2000 Anamoto
6,038,995 A 3/2000 Karafiath et al.
6,062,154 A 5/2000 Ito
6,086,437 A 7/2000 Murray
6,135,095 A 10/2000 Motose et al.
6,138,601 A 10/2000 Anderson et al.
6,148,777 A 11/2000 Motose et al.
6,159,059 A 12/2000 Bernier et al.
6,168,485 B1 1/2001 Hall et al.
6,171,159 B1 1/2001 Shen et al.
6,174,210 B1 1/2001 Spade et al.
6,178,907 B1 1/2001 Shirah et al.
6,202,584 B1 3/2001 Madachi et al.
6,213,044 B1 4/2001 Rodgers et al.
6,216,624 B1 4/2001 Page
6,227,919 B1 5/2001 Blanchard
6,244,914 B1 6/2001 Freitag et al.
6,273,771 B1 8/2001 Buckley et al.
6,305,307 B1 10/2001 Yokoya
6,314,900 B1 11/2001 Samuelsen
6,332,816 B1 12/2001 Tsuchiya et al.
6,336,833 B1 1/2002 Rheault et al.
6,336,834 B1 1/2002 Nedderman, Jr. et al.
6,386,930 B2 5/2002 Moffet
6,390,862 B1 5/2002 Eichinger
6,405,669 B2 6/2002 Rheault et al.
6,415,729 B1 7/2002 Nedderman, Jr. et al.
6,428,372 B1 8/2002 Belt
6,443,785 B1 9/2002 Swartz et al.
6,478,638 B2 11/2002 Matsuda et al.
6,508,680 B2 1/2003 Kanno
6,511,354 B1 1/2003 Gonring et al.
6,523,489 B2 2/2003 Simzrd et al.
6,530,812 B2 3/2003 Koyano et al.
6,551,152 B2 4/2003 Matsuda et al.
6,565,397 B2 5/2003 Nagafusa
6,568,968 B2 5/2003 Matsuda et al.
6,668,796 B2 12/2003 Umemoto et al.
6,695,657 B2 2/2004 Hattori
6,709,302 B2 3/2004 Yanagihara
6,709,303 B2 3/2004 Umemoto et al.
6,722,932 B2 4/2004 Yanagihara
6,732,707 B2 5/2004 Kidokoro et al.
6,733,350 B2 5/2004 Iida et al.
6,776,676 B2 * 8/2004 Tanaka et al. ..... 440/87
6,805,094 B2 10/2004 Hashimoto et al.
6,827,031 B2 12/2004 Aoyama
6,855,014 B2 2/2005 Kinoshita et al.
6,884,128 B2 * 4/2005 Okuyama et al. ..... 440/1
6,886,529 B2 5/2005 Suzuki et al.
6,990,953 B2 1/2006 Nakahara et al.
6,997,763 B2 * 2/2006 Kaji ..... 440/1
2002/0049013 A1 4/2002 Kanno
2003/0000500 A1 1/2003 Chatfield
2004/0067700 A1 4/2004 Kinoshita et al.
2004/0069271 A1 4/2004 Kanno et al.
2004/0147179 A1 7/2004 Mizuno et al.
2005/0263132 A1 12/2005 Yanagihara
2005/0273224 A1 12/2005 Ito et al.
2005/0287886 A1 12/2005 Ito et al.
2006/0004502 A1 1/2006 Kaneko et al.
2006/0037522 A1 2/2006 Kaneko et al.

FOREIGN PATENT DOCUMENTS

JP 06-137248 5/1994
JP 7-40476 9/1995
JP 2001-152895 6/2001
JP 2001-329881 11/2001
JP 2002-180861 6/2002
JP 2004-092640 3/2004
JP 2004-137920 5/2004
WO WO 00/40462 7/2000

OTHER PUBLICATIONS

Co-Pending U.S. Appl. No. 11/083,256 filed Mar. 17, 2005. Now published as U.S. 2006-057026A1 (submitted herewith). Title: Engine Control Device. Inventor: Ishida et al.
Co-Pending U.S. Appl. No. 11/335,996 filed Jan. 20, 2006. Now published a U.S. 2006-0160437A1 (submitted herewith). Title: Operation Control System For Small Boat. Inventor: Kinoshita et al.
Co-Pending U.S. Appl. No. 11/146,980 filed Jun. 7, 2005. Now published a U.S. 2006-0037522A1 (submitted herewith). Title: Steering-Force Detection Device For Steering Handle Of Vehicle. Inventor: Kaneko et al.
Co-Pending U.S. Appl. No. 11/146,728 filed Jun. 7, 2005. Now published as U.S. 2006-004502A1 (submitted herewith). Title: Steering Force Detection Device For Steering Handle Of Vehicle. Inventor: Kaneko et al.
Co-Pending U.S. Appl. No. 11/169,374 filed Jun. 29, 2005. Now published as U.S. 2005-0287886A1 (submitted herewith). Title: Engine Output Control System For Water Jet Propulsion Boat. Inventor: Ito et al.
Co-Pending U.S. Appl. No. 11/135,890 filed May 24, 2005. Now published as U.S. 2005-0273224A1 (submitted herewith). Title: Speed Control Device For Water Jet Propulsion Boat . Inventor: Ito et al.
Co-Pending U.S. Appl. No. 10/624,094 filed Jul. 21, 2003. Now issued as U.S. Appl. No.7,037,147 (submitted herewith). Title: Engine Control System For Watercraft. Inventor: Ito et al.
Co-Pending U.S. Appl. No. 10/619,333 filed Jul. 14, 2003. Now issued as U.S. Appl. No. 7,089,910 (submitted herewith). Title:Watercraft Propulsion System And Control Method Of The Systemengine Control System For Watercraft. Inventor: Kanno et al.
Co-Pending U.S. Appl. No.10/872,013 filed Jun. 18, 2004. Now published as US 2005-0085141A1 (submitted herewith). Title: Engine Control Arrangement For Watercraft. Inventor: Motose.
Co-Pending U.S. Appl. No. 10/862,267 filed Jun. 7, 2004. Now published as US 2005-0009419A1 (submitted herewith). Title: Engine Control Arrangement For Watercraft. Inventor: Kinoshita.
Advertisement for trim adjuster for Sea-Doo watercraft- Personal Watercraft Illustrated, Aug. 1998.
Advertisement for trim adjuster- Jet Sports, Aug. 1997.
Advertisement for Fit and Trim and Fit and Trim II- Jet Sports. Aug. 1996.

* cited by examiner

OPERATION CONTROL SYSTEM FOR PLANING BOAT

PRIORITY INFORMATION

The present application is based on and claims priority under 35 U.S.C. § 119(a–d) to Japanese Patent Application No. 2005-012847, filed on Jan. 20, 2005 the entire contents of which is expressly incorporated by reference herein.

BACKGROUND OF THE INVENTIONS

1. Field of the Inventions

These inventions relate to a planning-type watercraft, and more particularly to improvements in operation control systems for such watercraft.

2. Description of the Related Art

When driving a watercraft into or out of a marina, operators must drive at speeds lower than about five miles per hour. These areas are all often referred to as "No Wake Zones." Operating a boat at such a low speed can be tiresome.

For example, watercraft that include throttle levers that are biased toward a closed position, such as those used on personal watercraft and some jet boats, require the operators to hold the throttle lever with their fingers or foot in a position so as to hold the throttle lever at a precise location so that the watercraft will move only at a slow speed. Thus, more recently, some small watercraft have been provided with cruise control systems that facilitate smooth acceleration for cruising in a speed-limited area as well as for longer cruising uses.

For example, Japanese Patent Document JP-A-2002-180861 discloses a cruise control system for a planning-type watercraft in which, with a throttle valve opened to a driver-determined position, the driver can turn-on a cruise control operation switch to control the degree of throttle opening such that the then current engine speed is maintained.

SUMMARY OF THE INVENTIONS

An aspect of at least one of the embodiments disclosed herein includes the realization that when using a cruise control system such as that described in JP-A-2002-180861, the watercraft can change cruising speed significantly even if the engine speed is maintained at a constant speed. This is due to the differences in hydrodynamic drag on the hull when the watercraft is in a displacement mode compared to when the watercraft is in a planning mode. For example, if an engine speed is held constant, and the watercraft transitions from a displacement mode (in which the drag on the hull is higher) to a planning mode (in which the drag on the hull is lower), the watercraft accelerates and begins to cruise at a higher watercraft speed, even if the speed of the engine is held constant.

As shown in FIGS. 9(*a*) and 9(*b*), users can accelerate planning-type boats under the maximum engine speed by abruptly increasing the throttle opening from an idle throttle opening to a full throttle opening. This, however, results in a delay in increasing the cruising speed relative to the almost immediate increase in engine speed to the maximum engine speed.

Thus, with a conventional cruise control system, when the driver turns-on the cruise control operation switch during displacement more operation (before planning), the engine speed is fixed at the then current speed. Under certain situations, the boat starts planing under this fixed engine speed. This results in the cruising speed of the watercraft being higher than the speed of the watercraft when the cruise control was actuated. Drivers can find this acceleration unacceptable.

Thus, in accordance with an embodiment, an operation control system for a planning-type boat can be provided. The control system can include mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated. The system can further comprise planing condition determination means for determining whether a hull of the planning-type boat is at a stage of planing. The mode selection means can prohibit the driving mode from switching to the speed-fixing mode if the planing condition determination means determines that the hull is not at the stage of planing. The mode selection means can also permit the driving mode to switch to the speed-fixing mode if the planing condition determination means determines that the hull is at the stage of planing.

In accordance with another embodiment, an operation control system for a planning-type boat can be provided. The boat can include a hull, an engine supported by the hull, an acceleration input device configured to be operable by a driver of the boat. A mode selection module can be configured to allow a driver of the boat to select a driving mode, the driving mode comprising at least one of a normal operation mode, in which the boat cruises at a speed in response to the displacement of the acceleration input device, and a speed-fixing mode in which the boat cruises at a fixed speed determined when a speed-fixing controller is operated. The system can further comprise a planing condition determination module configured to determine whether the hull is at a stage of planing. The mode selection module can also be configured to prohibit the driving mode from switching to the speed-fixing mode if the planing condition determination module determines that the hull is not at the stage of planing, and configured to permit switching of the driving mode to the speed-fixing mode if the planing condition determination module determines that the hull is at the stage of planing.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
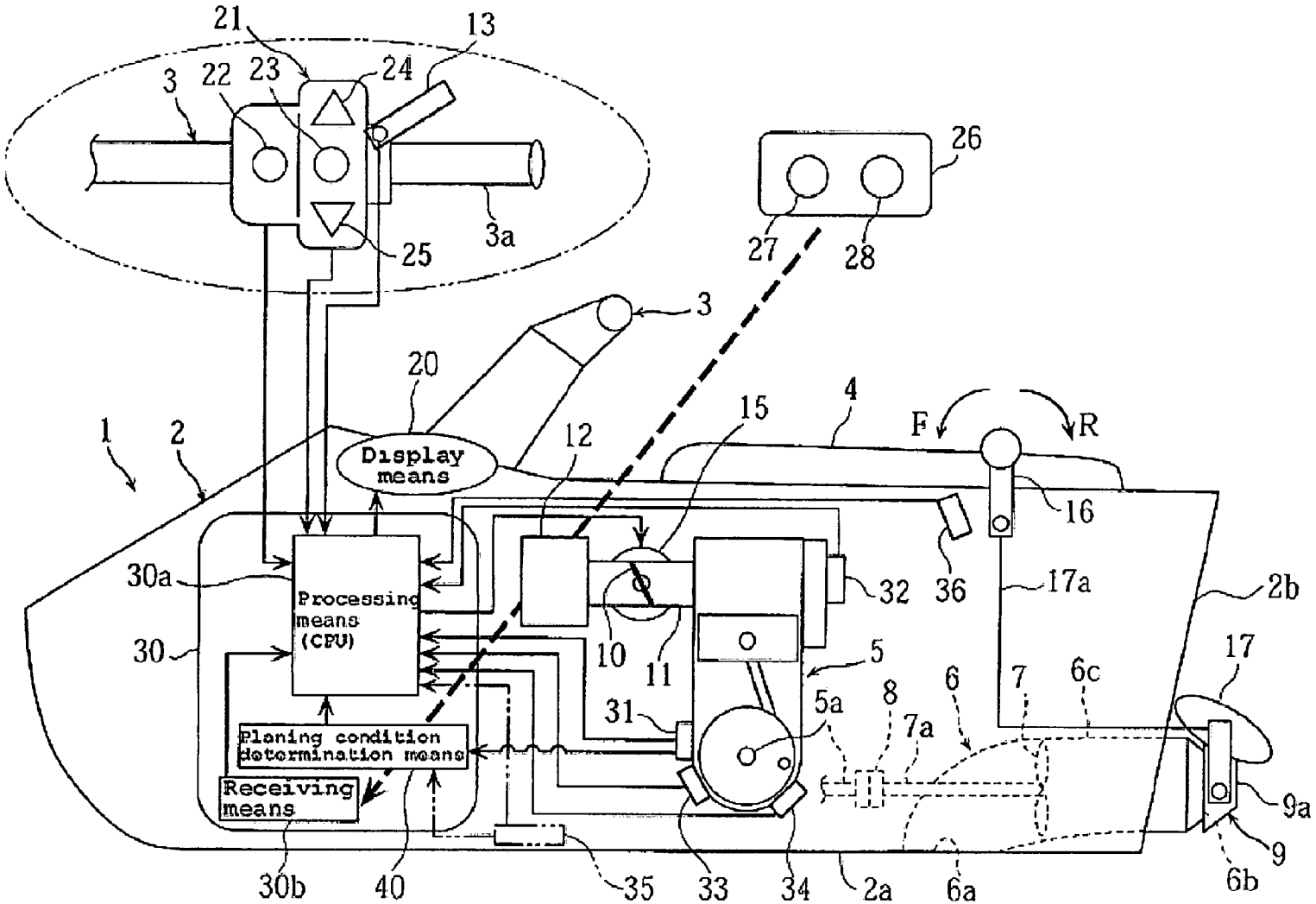
FIG. 1 is a schematic diagram of a planning-type boat having an operation control system according to an embodiment.
Figure 2:
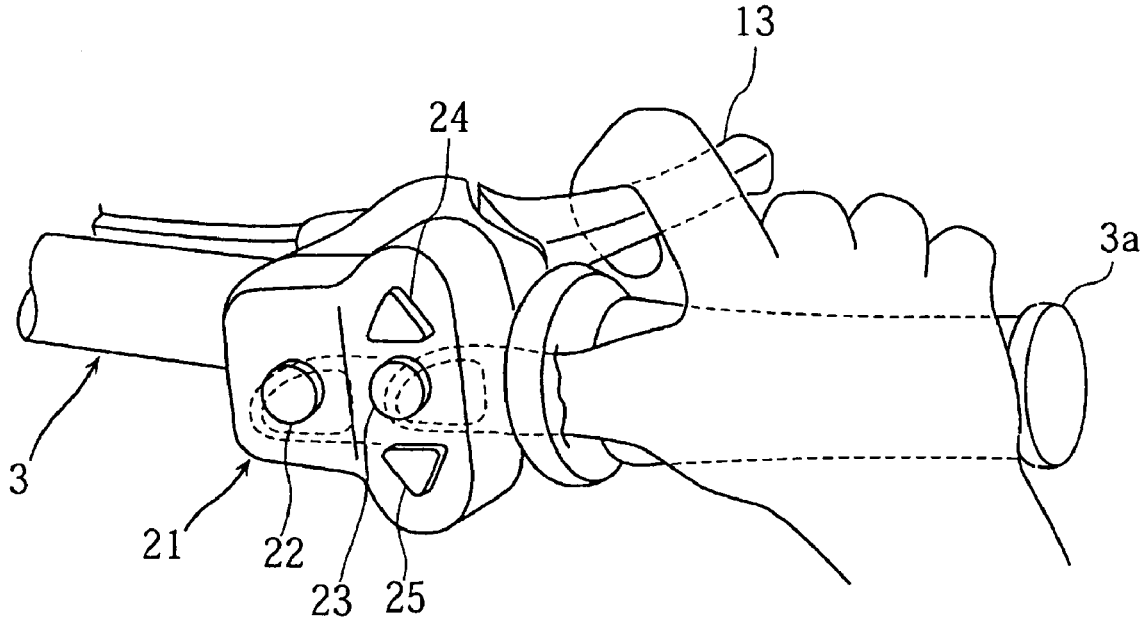
FIG. 2 is an enlarged perspective view of a portion of a steering handlebar of the planning-type boat.

The planing boat 1 can include a box-shaped, generally watertight hull 2, a steering handlebar 3 located at the forward upper surface of the hull, a straddle type seat 4 located at the rearward upper surface of the hull, an engine 5 and a propulsion unit 6 both accommodated in the hull 2. However, other configurations can also be used. The operation control system and methods described herein are disclosed in the context of a personal watercraft because they have particular utility in this context. However, the operation control system and methods described herein can also be used in other vehicles, including small jet boats, as well as other watercraft and land vehicles.

The propulsion unit 6 can include an inlet port 6*a* having an opening at a bottom 2*a* of the hull 2, an outlet port 6*b* having an opening at a stern 2*b*, and a propulsion passage 6*c*. The inlet and outlet ports can communicate through the propulsion passage.

An impeller 7 can be disposed within the propulsion passage 6*c*. An impeller shaft 7*a* of the impeller 7 can be coupled to a crankshaft 5*a* of the engine 5 through a coupling 8. The impeller shaft 7 can be comprised of one or plurality of shafts connected together. The engine 5 can thus drive the impeller 7 so as to rotate. This pressurizes the water drawn from the inlet port 6*a* and emits a jet of the pressurized water rearward from the outlet port 6*b*, thereby producing thrust.

To the outlet port 6*b*, a jet nozzle 9 can be connected for swinging movement to the left or right. The handlebar 3 can be connected to the jet nozzle 9 with any known connection device. Thus, steering the steering handlebar 3 to the left or right allows the jet nozzle 9 to swing left or right, thereby turning the hull 2 left or right.

The engine 5 can be mounted with its crankshaft 5*a* oriented in the front-to-rear direction of the hull, however, other configurations or orientations can also be used.

A throttle body 11 incorporating a throttle valve 10 can be connected to the engine 5. A silencer 12 can be connected to the upstream end of the throttle body 11.

An acceleration lever (controller) 13 can be disposed at a grip portion 3*a* of the steering handlebar 3 and can be operated, by a driver of the planing-type boat, to open/close the throttle valve 10. An actuator 15 can be connected to the throttle valve 10 to open/close the throttle valve 10. A control unit 30, described in greater detail below, drives and controls the actuator 15.

A forward/reverse drive shift lever 16 (which can function as a forward/reverse drive shifting means) can be disposed in the vicinity of the seat provided on the hull 2. The forward/reverse drive shift lever 16 can be linked to a reverse bucket 17 disposed on the jet nozzle 9 via an operation cable 17*a*.

When the forward/reverse drive shift lever 16 is rotated to a forward-drive position F, the reverse bucket 17 can be moved to allow a jet port 9*a* of the jet nozzle 9 to be opened. Water jet can be directed rearward so that the hull 2 moves forwardly. When the forward/reverse drive shift lever 16 is rotated to a reverse-drive position R, the reverse bucket 17 can be positioned to the rear of the jet port 9*a*. Water jet flow hits the reverse bucket 17 and is thus redirected toward the front of the hull 2, thereby moving the hull 2 in a reverse direction.

The steering handlebar 3 on the hull 2 can be provided with an operation box 21. In front of the steering handlebar 3, a display device 20 can also be provided. Reference numeral 26 denotes a remote control switch. The remote control switch 26 may be disposed on the hull.

The display device 20 can include a speedometer, a fuel gauge, and various display lamps (not shown). However, other gauges and displays can also be used. When any one of a low-speed setting mode, a speed-limiting mode and a speed-fixing mode is selected with, for example, the operation box 21, the display device lights a display lamp that responds to the selected mode.

The operation box 21 can be located inner side of the grip portion 3*a* of the steering handlebar 3 in the vehicle width direction. The operation box 21 can be provided with a low-speed setting switch 22, a speed-fixing switch 23, and acceleration/deceleration fine adjustment switches 24, 25. All the switches 22 to 25 can be disposed in an area where the driver's thumb can reach for operating these switches while the driver grabs the grip portion 3*a*. However, other configurations and arrangements can also be used. The remote control switch 26 can be provided with a speed-limiting switch 27 and a speed-limiting cancellation switch 28.

The planing boat 1 can have a control unit 30 for controlling all operations of the boat 1 including the engine. The control unit 30 can be configured to receive input values detected by various sensors including an engine speed sensor 31, a throttle opening sensor (not shown), an engine coolant temperature sensor 32, a lubricant temperature sensor 33, a lubricant pressure sensor 34, a cruising speed sensor 35 and a forward/reverse drive shift position sensor 36. However, other sensors can also be used.

Figure 4:
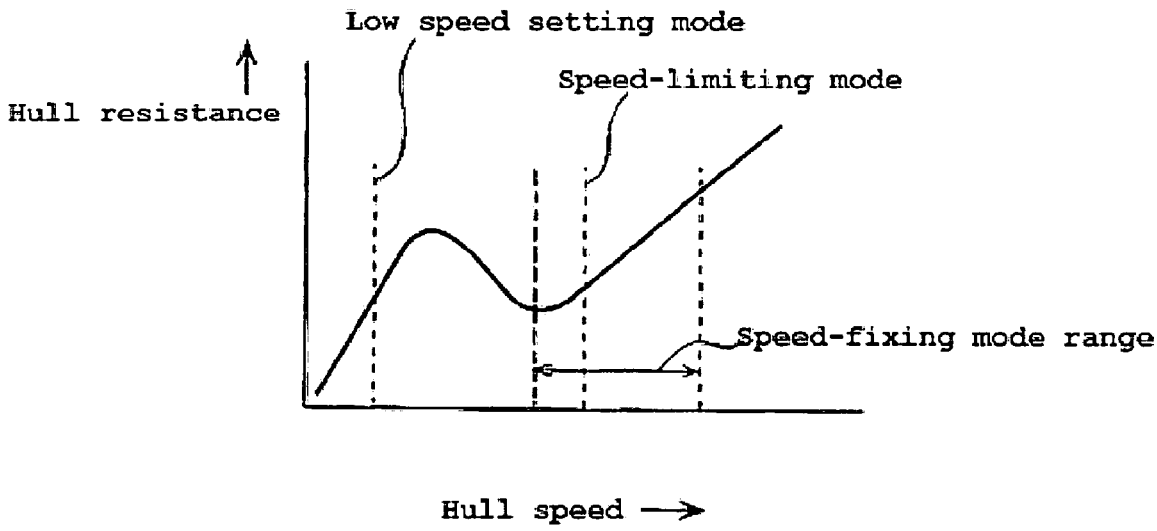
FIG. 4 is an exemplary but nonlimiting characteristic map, showing operation ranges of the planning-type boat in various modes.

The control unit 30 can include processing means (CPU) 30*a* for driving and controlling the actuator 15 and the like. The processing means 30*a* can be configured to receive operation signals input from the low-speed setting switch 22, the speed-fixing switch 23, and the acceleration/deceleration fine adjustment switches 24, 25, and/or other switches or input devices. The processing means 30*a* can also be configured to receive operation signals input from the speed-limiting switch 27 and the speed-limiting cancellation switch 28 through receiving means 30*b*, and/or other switches or input devices. The control unit 30 can be configured to select among the cruising modes based on the operation signals from the switches (See FIG. 4).

For example, while in the normal operation mode, in which the boat 1 cruises at a speed in response to the displacement of the acceleration lever 13 by the driver, the low-speed setting switch 22 can be kept pressed by the driver, for example, for a certain time period. Then, the control unit 30 can change the mode to the low-speed setting mode and control the throttle opening to achieve a predetermined low boat speed (e.g. 8 km/h). The low-speed setting mode can be applicable to cruising in a limited or reduced speed area, such as shallow water, boat mooring sites, no wake zones, or other areas.

When the normal operation mode is selected, the speed-limiting switch 27 can also be depressed for a certain time period. Then, the control unit 30 can change the operation mode of the engine to the speed-limiting mode and control the throttle opening such that the engine speed does not exceed a predetermined value. The control unit 30 can be configured not to change the mode to the speed-fixing mode if the speed-limiting mode has already been selected. The speed-limiting mode can be applicable to cruising in a speed limited area or long-time or longer-distance touring.

When the normal operation mode is selected, the speed-fixing switch 23 can be depressed for a certain time period. Then, the control unit 30 can change the driving mode to the speed-fixing mode, which can be the automatic cruising mode, and can control the throttle opening to fix the cruising speed of the boat 1 at the then current boat speed when the speed-fixing switch is pressed. The speed-fixing mode can be applicable to cruising at driver's desirable speed from low to high speed range, or at a speed which improves fuel efficiency.

The control unit 30 can include a planing condition determination means 40 for determining whether or not the hull 2 is at the stage of planing. If the planing condition determination means 40 determines that the hull is at the stage of planing, the control unit permits the driving mode to switch to the speed-fixing mode. If the planing condition determination means 40 determines that the hull is not at the stage of planing, the control unit prohibits the driving mode from switching to the speed-fixing mode. The planing condition determination means 40 can be configured to determine whether or not the hull 2 is in a planing or displacement mode using any of a variety of calculations, including, but without limitation, an average based on a detected speed of the engine.

For example, if a moving average is calculated based on a detected engine speed is kept lower than a preset value for a predetermined time period, the boat can be determined not to be in a planning mode. If the moving average is maintained higher than the preset value for the predetermined time period, the boat can be determined to be at or in a planning mode.

The aforementioned moving average can refer to an engine speed obtained based on a simple moving average, weighted moving average and/or smoothed exponential moving average. For example, the moving average Ne calculated based on the simple moving average can be expressed as follows:

$$Ne=(N_1+N_2+N_3+N_4)/4$$

where $N_1$, $N_2$, $N_3$, $N_4$ are engine speeds sampled at certain intervals by the engine speed sensor 31.

The moving average Ne calculated based on the weighted moving average can be expressed as follows:

$$Ne=(N_1\times K_1+N_2\times K_2+N_3\times K_3+N_4\times K_4)/(K_1+K_2+K_3+K_4)$$

wherein Kn is a sampling weighted coefficient and Kn>Kn−1>1. The moving average $Ne_t$ at time t calculated based on the smoothed exponential moving average can be expressed as follows:

$$Ne_t=Ne_{t-1}+(N_t-Ne_{t-1})\times K$$

wherein K is resistance coefficient of the boat.

Figure 3:
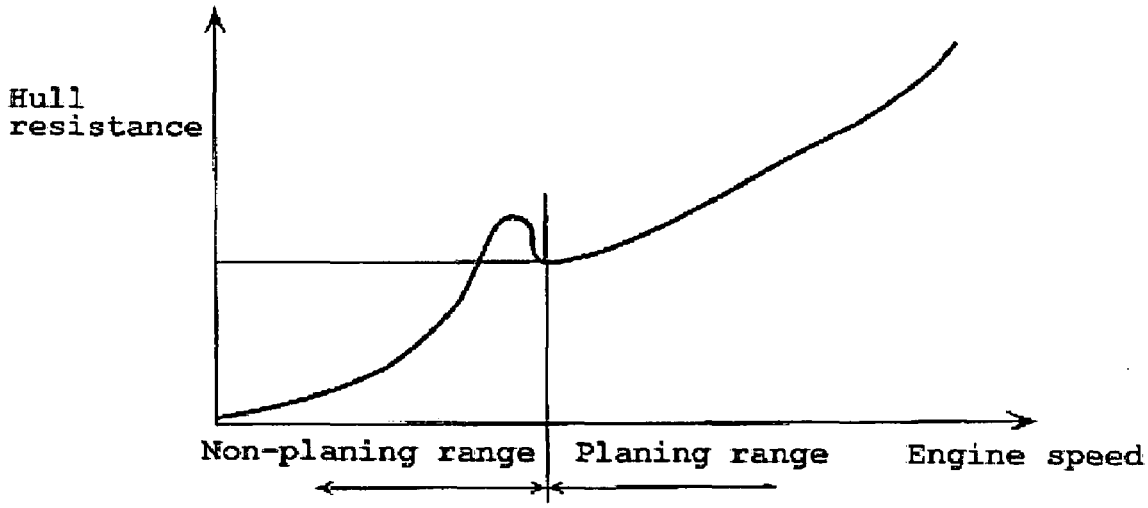
FIG. 3 is an exemplary but nonlimiting characteristic map, showing a relationship between hull resistance of the planning-type boat and engine speed.

FIG. 3 shows an exemplary but non-limiting relationship between engine speed and hull resistance, and particularly shows a sharp increase in hull resistance just prior to the border between non-planing and planing ranges. As the engine speed, and then the cruising speed, increase from the idling level and approximate to a level of the border, the hull weighted center moves to the rear of the hull. This causes a sharp increase in hull resistance as shown in the FIG. 3. When the engine speed further increases to a certain speed, referred to herein as the "hump speed", the hull weighted center moves toward the front of the hull 2, and the hull 2 also rises somewhat relative to the waterline of the hull 2 so that the hull 2 resistance decreases. A range of speeds over the hump can be called the planing range.

Figure 5:
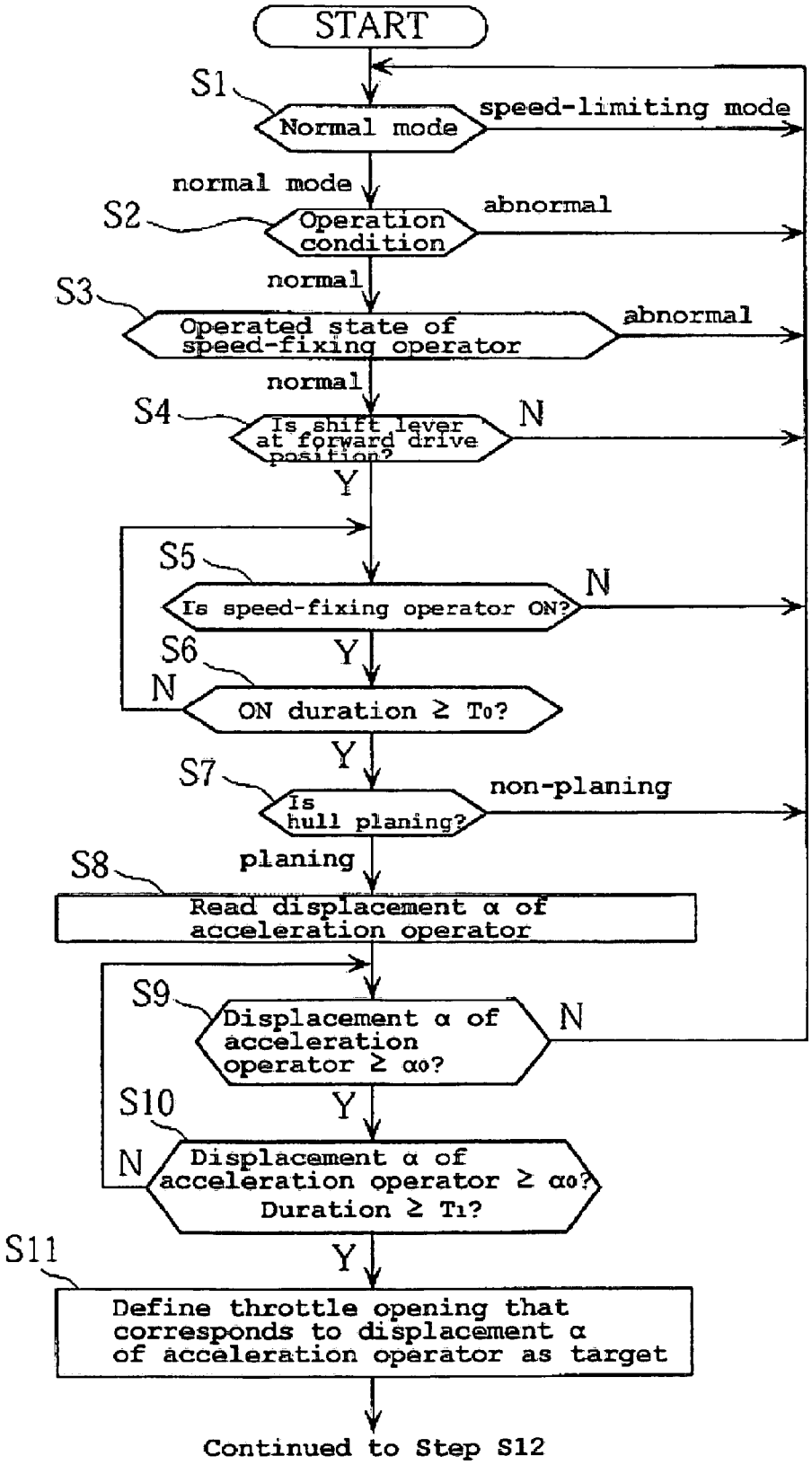
FIG. 5 is a flowchart of a control operation that can be used with the operation control system of FIG. 1.

A control operation that can be used with the control unit 30 is described in detail with reference to the flowcharts in FIGS. 5 and 6.

When a main switch is turned ON to start the engine 5, a determination can be made whether or not the normal operation mode has been selected. If it is determined that the normal operation mode has been selected, another determination can be made whether or not the engine operates and each sensor functions normally. Then, a further determination can be made whether or not the speed-fixing switch 23 is operated normally (steps S1 to S3). These determinations can be made in any known manner, for example, through known diagnostic routines for verifying the proper operation of sensors and/or other engine functions.

If all are determined to be under normal conditions in the steps S2 and S3, another determination can be made whether or not the forward/reverse drive shift lever 16 is at the forward drive position (step S4). If the forward/reverse drive shift lever 16 is determined to be at the forward drive position F, a further determination can be made whether or not the speed-fixing switch 23 has been turned ON (step S5).

If the speed-limiting mode has been selected in the step S1, or the engine fails to operate normally or the switch fails to be operated normally in the steps S2 and S3, or the forward/reverse drive shift lever is at the reverse drive position in the step S4, the process flow goes back to the step S1 to repeat the process.

The engine 5 can be determined not to operate normally, for example, if at least one of the lubricant temperature, coolant temperature and lubricant pressure exceeds its preset value.

The speed-fixing switch 23 can be determined not to be operated normally if a voltage of a lead wire for connecting the speed-fixing switch 23 to the control unit 30 does not fall within a normal value range. In addition, if the voltage value, obtained when the speed-fixing switch 23 is operated, can be kept normal for a predetermined time period or longer, the operated state of the switch can be determined to be abnormal because of a possibility that the speed-fixing switch 23 could be forcibly stuck in the ON position due to dust.

If the speed-fixing switch 23 is turned ON in the step S5, the duration that the switch can be kept ON is measured. If the duration is equal to or longer than a preset time $T_0$, a determination can be made whether or not the hull is at the stage of planing (steps S6 and S7). If the duration that the switch is kept ON is shorter than $T_0$ in the step S6, the process flow goes back to the step S5.

If the hull is determined to be at the stage of planing in the step S7, a current displacement $\alpha$ of the acceleration lever 13 can be read (step S8). If the current displacement $\alpha$ is equal to a preset value $\alpha_0$ or greater, the duration that the displacement $\alpha$ is maintained is measured. If the duration is equal to $T_1$ or longer (steps S9 and S10), a throttle opening that corresponds to the displacement $\alpha$ is defined as a target while the display lamp lights to indicate that the speed-fixing mode can be selected (steps S11 and S12 (FIG. 6)). The opening/closing degree of the throttle valve 10 can be controlled through the actuator 15 such that the throttle opening reaches and is maintained at the target.

Figure 6:
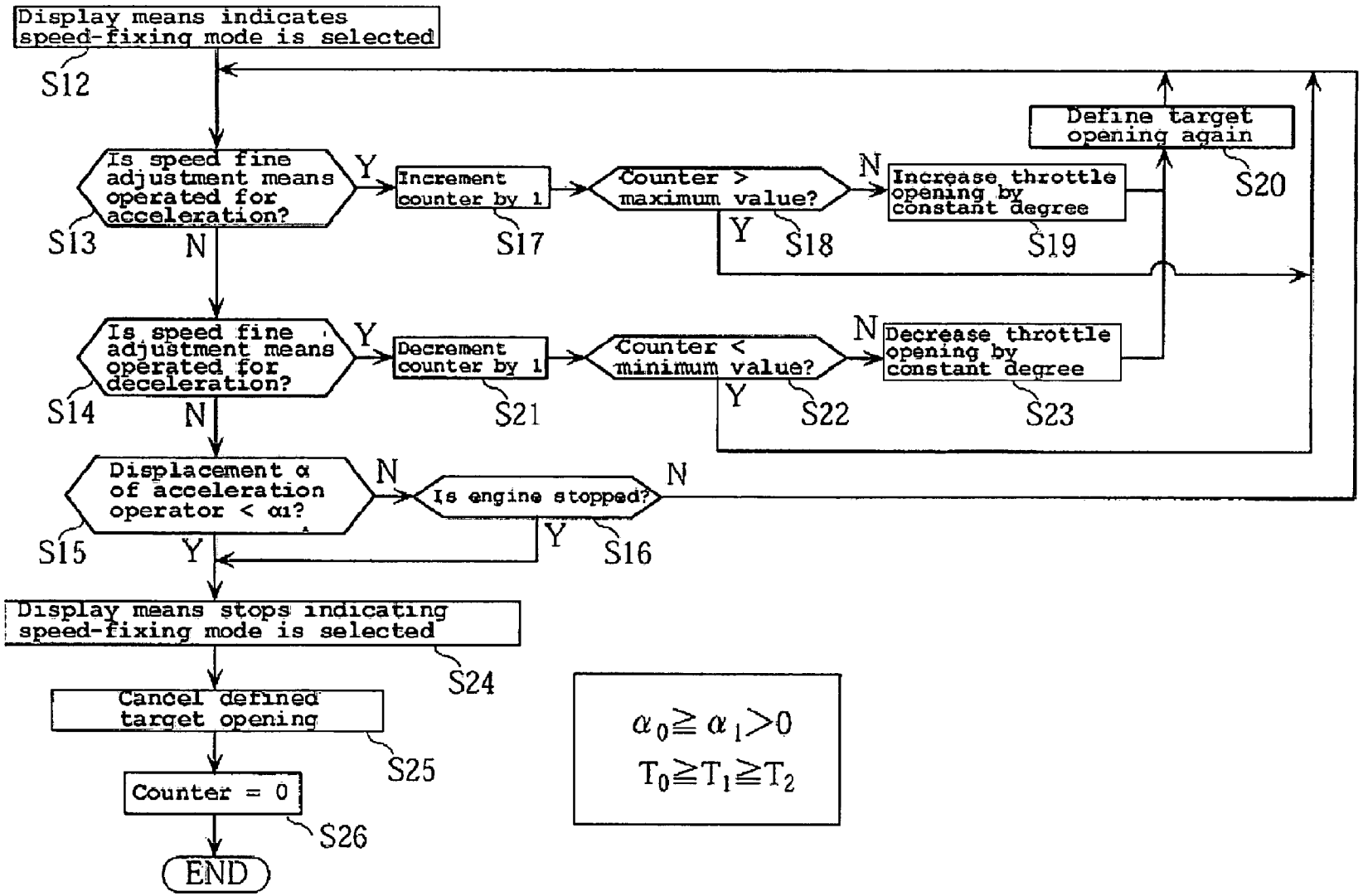
FIG. 6 is a flowchart of a control operation that can be used with the operation control system of FIG. 1.

With continued reference to FIG. 6, while the boat cruises in this speed-fixing mode, if fine adjustments for acceleration/deceleration are not implemented, the displacement $\alpha$ of the acceleration lever 13 is equal to or greater than a predetermined value $\alpha_1$, and the engine 5 is not stopped, then the speed-fixing mode can be maintained (steps S13 to S16).

In the step S13, if the acceleration fine adjustment switch 24 is pressed, a counter value can be increased by one. If the counter value does not reach the maximum value, the throttle opening can be increased by a constant degree, which is again defined as the target (steps S17 to S20). In the step S14, if the deceleration fine adjustment switch 25 is pressed, a counter value can be decreased by one. If the counter value does not reach the minimum value, the throttle opening can be decreased by a constant degree, which is again defined as the target (steps S21 to S23).

If the displacement $\alpha$ of the acceleration lever 13 becomes lower than the predetermined value $\alpha_1$, the control unit can be configured to determine that the driver desires to clear the speed-fixing mode. Thus, the lamp that indicates the speed-fixing mode has been selected goes out. The defined target throttle opening becomes invalid while the increasing/decreasing counter value can be reset to zero (steps S24 to S26). This allows the speed-fixing mode to automatically switch to the normal operation mode. In the step S16, if the engine is stopped, the speed-fixing mode can be cleared to automatically switch to the normal operation mode.

According to some embodiments, if the speed-fixing switch 23 is kept pressed for a certain time period, a determination can be made whether or not the hull 2 is at the stage of planing. Only if the hull is determined to be at the stage of planing, the control unit permits the driving mode to switch to the speed-fixing mode. This enables driver's desired cruising speed to conform to the actual cruising speed, thereby offering cruising comfort for the driver.

In some embodiments, the hull 2 can be determined not to be at the stage of planing, if the moving average obtained based on the engine speed is kept lower than a preset value for a certain time period. This allows the control unit to make a determination whether the hull 2 is at the stage of planing based on a cruising speed that is about the actual speed, using a simpler and less expensive configuration. Further, this makes the determination more accurate, compared to the determination made by using the engine speed itself as a criterion.

In some embodiments, if the forward/reverse drive shift lever 16 is at the reverse-drive position R, the control unit prohibits the driving mode from switching to the speed-fixing mode. This can help the driver refrain from unnecessary operations. In other words, there can be little need or opportunity to switch to the speed-fixing mode during reverse drive.

In some embodiments, if the boat cruises in the speed-fixing mode and the displacement $\alpha$ of the acceleration lever is equal to or greater than the predetermined value $\alpha_1$, then the speed-fixing mode can be maintained. Thus, the driver can maintain the speed-fixing mode with simple operations while easily recognizing that the boat cruises in the speed-fixing mode.

In some embodiments, if the displacement $\alpha$ of the acceleration lever is lower than the predetermined value $\alpha_1$, the speed-fixing mode can be cleared to automatically switch to the normal operation mode. This can be achieved by simple operations.

In some embodiments, if the engine fails to operate normally or each sensor fails to function normally, the control unit 30 can be configured to prohibit the driving mode from switching to the speed-fixing mode. This helps the driver easily recognize that any anomaly occurs, thereby preventing problems with the engine that would continue to operate abnormally.

In turn, if the operated state of the speed-fixing switch 23 is abnormal, the control unit 30 can be configured to prohibit the driving mode from switching to the speed-fixing mode. This helps the driver easily recognize that any anomaly occurs, thereby preventing problems with the speed-fixing switch 23 that would continue to be operated abnormally.

In some embodiments, the acceleration/deceleration fine adjustment switches 24, 25 are provided for finely adjusting the cruising speed when the boat cruises in the speed-fixing mode. This can offer the driver fine adjustments of the cruising speed to his/her desired speed.

The aforementioned embodiments are directed to some examples in which the speed-fixing mode can be achieved by controlling the throttle opening. However, the speed-fixing mode may also be achieved by controlling the engine speed or cruising speed.

Figure 7:
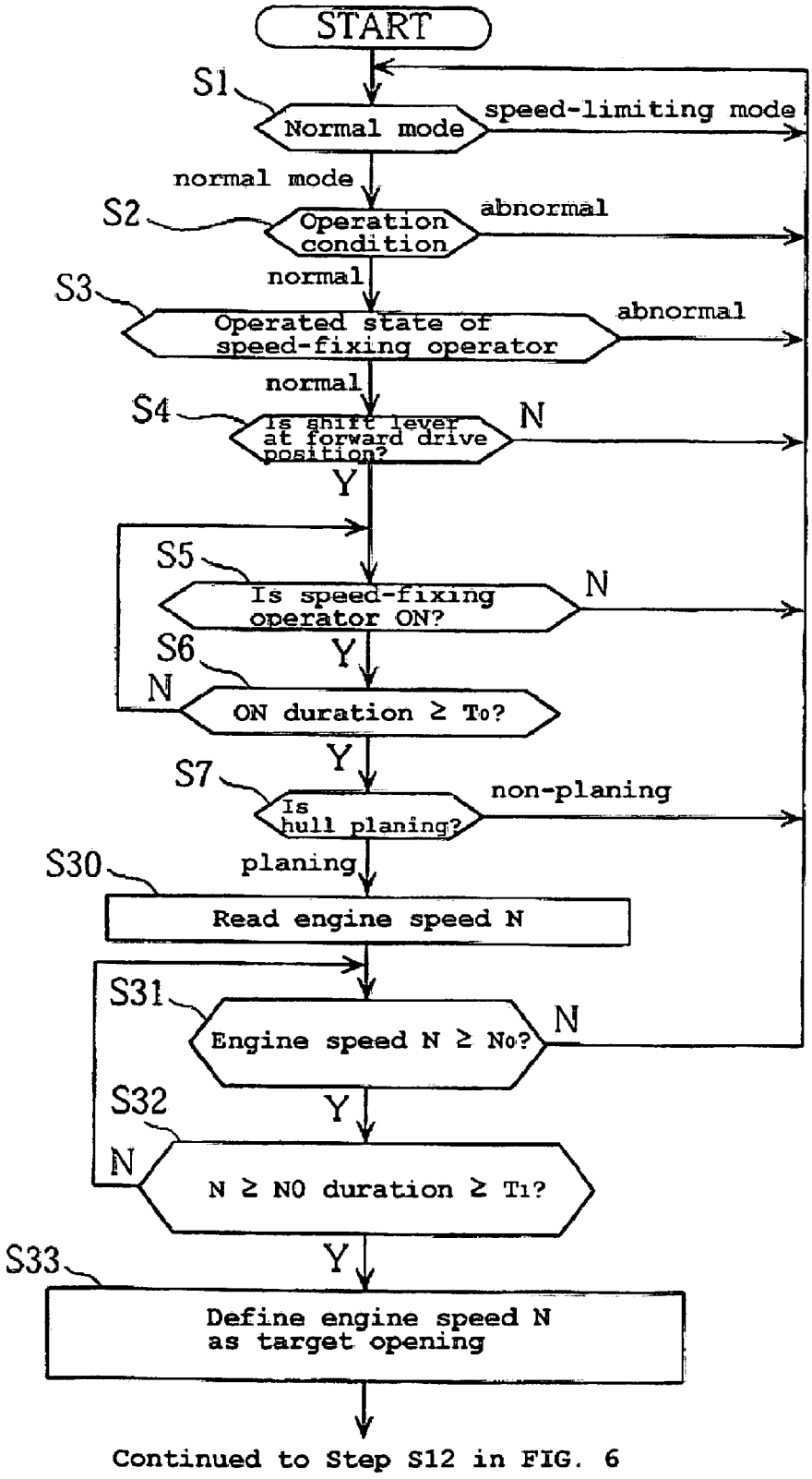
FIG. 7 is a flowchart for another control operation that can be used with the operation control system of FIG. 1.

FIG. 7 is a flowchart of another program for controlling the engine speed to achieve a speed-fixing mode. In FIG. 7, similar or equivalent parts are designated by the same numerals as in FIG. 5.

In the normal operation mode, if the engine operates normally, the speed-fixing switch can be operated normally, and the shift lever can be at the forward-drive position, then the speed-fixing switch can be turned ON. If the speed-fixing switch is kept ON for a certain time period $T_0$ or longer, the control unit judges that the driver has selected the automatic cruising, and determines whether or not the hull is at the stage of planing (steps S1 to S7).

If the hull is determined to be at the stage of planing, a current engine speed N can be read (step S30). A determination can be made whether or not the current engine speed N is equal to or greater than a preset value $N_0$. If the engine speed N is equal to or greater than $N_0$ and is kept for a certain time period $T_1$ or longer, this engine speed N can be defined as a target (steps S31 to S33). Thereby, the throttle opening can be controlled such that the engine speed reaches the target.

Figure 8:
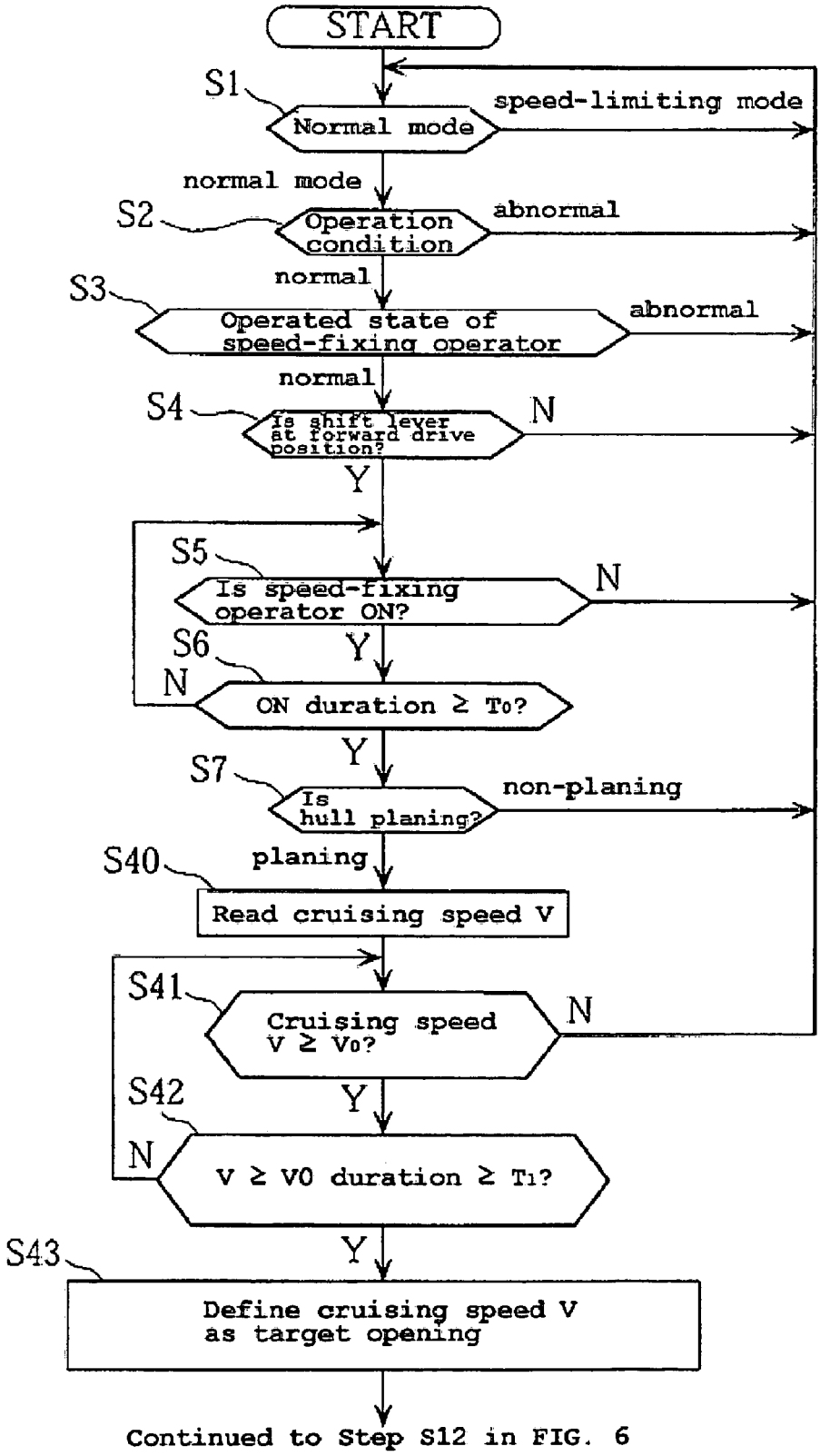
FIG. 8 is a flowchart for another control operation program that can be used with the operation control system of FIG. 1.
Figure 9:
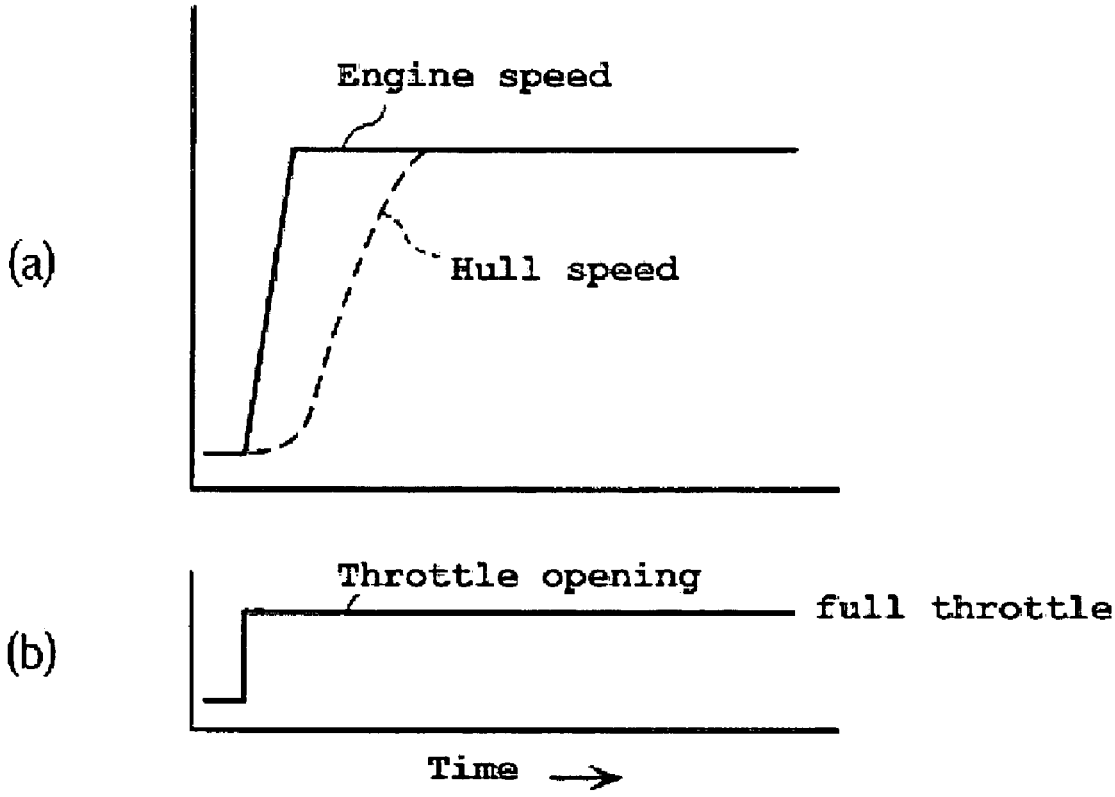
FIGS. 9(*a*) and 9(*b*) are schematic illustrations of maps for describing a process to practice the embodiments described herein.

FIG. 8 is a flowchart of a program for controlling the cruising speed to achieve the speed-fixing mode. In the figure, similar or equivalent parts are designated by the same numerals as in FIG. 5.

In the normal operation mode, if the engine operates normally, the speed-fixing switch is operated normally, and the shift lever is at the forward-drive position, then the speed-fixing switch is turned ON. If the speed-fixing switch is kept ON for a certain time period $T_0$ or longer, the control unit 30 determines that the driver has selected the automatic cruising, and determines whether or not the hull 2 is at the stage of planing (steps S1 to S7).

If the hull 2 is determined to be at the stage of planing, a current cruising speed V can be read (step S40). A determination can be made whether or not the cruising speed V is equal to or greater than a preset value $V_0$. If the cruising speed V is equal to or greater than $V_0$ and is kept for a certain time period $T_1$ or longer, this cruising speed V can be defined as a target (steps S41 to S43). Thereby, the throttle opening can be controlled such that the cruising speed reaches the target.

The speed-fixing mode is achieved by controlling the engine speed and the cruising speed in the manner as described, which also provides the same effects as those obtained in the aforementioned embodiments.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An operation control system for a planning-type boat comprising mode selection means for selecting a driving mode, the driving mode comprising at least one of a normal operation mode, in which the boat cruises at a speed in response to the displacement of an acceleration controller, and a speed-fixing mode in which the boat cruises at a fixed speed determined when a speed-fixing controller is operated, the system further comprising planing condition determination means for determining whether a hull of the planning-type boat is at a stage of planing, wherein the mode selection means prohibits the driving mode from switching to the speed-fixing mode if the planing condition determination means determines that the hull is not at the stage of planing, and wherein the mode selection means permits the driving mode to switch to the speed-fixing mode if the planing condition determination means determines that the hull is at the stage of planing.

2. The operation control system for a planing boat according to claim 1, wherein the planing condition determination means determines that the hull is not at the stage of planing if an engine speed or cruising speed is kept lower than a preset value for a predetermined time period.

3. The operation control system for a planing boat according to claim 1, wherein the planing condition determination means determines that the hull is not at the stage of planing if a moving average obtained based on the engine speed is kept lower than a preset value for a predetermined time period.

4. The operation control system for a planing boat according to claim 1, wherein a speed-limiting mode is provided as an option to control the engine speed so as not to exceed the preset value, and the mode selection means permits the driving mode to switch to the speed-limiting mode if the normal operation mode has been selected, and the mode selection means prohibits the driving mode from switching to the speed-fixing mode if the speed-limiting mode has been selected.

5. The operation control system for a planing boat according to claim 1, further comprising forward/reverse drive shift means for changing the direction of thrust generated by a propulsion unit to either forward or reverse direction, wherein the mode selection means permits the driving mode to switch to the speed-fixing mode if the forward/reverse drive shift means has been shifted to a forward drive position, and the mode selection means prohibits the driving mode from switching to the speed-fixing mode if the forward/reverse drive shift means has been shifted to a reverse drive position.

6. The operation control system for a planing boat according to claim 1, wherein the mode selection means maintains the speed-fixing mode if the speed-fixing mode has been selected and if the displacement of the acceleration controller is equal to or greater than a preset value.

7. The operation control system for a planing boat according to claim 6, wherein the mode selection means clears the speed-fixing mode to automatically switch to the normal operation mode if the speed-fixing mode has been selected and if the displacement of the acceleration controller is lower than the preset value.

8. The operation control system for a planing boat according to claim 1, further comprising anomaly detecting means for detecting an anomaly in at least any one of engine operation and all detecting means, wherein the mode selection means prohibits the driving mode from switching to the speed-fixing mode if the anomaly is detected.

9. The operation control system for a planing boat according to claim 1, further comprising abnormal operation detecting means for detecting an abnormal operated state of the speed-fixing controller, wherein the mode selection means prohibits the driving mode from switching to the speed-fixing mode if the abnormal operated state is detected.

10. The operation control system for a planing boat according to claim 1, further comprising speed adjustment means for increasing/decreasing the cruising speed gradually by small degrees in accordance with inputs from a driver when the speed-fixing mode has been selected.

11. An operation control system for a planning-type boat comprising a hull, an engine supported by the hull, an acceleration input device configured to be operable by a driver of the boat, a mode selection module configured to allow a driver of the boat to select a driving mode, the driving mode comprising at least one of a normal operation mode, in which the boat cruises at a speed in response to the displacement of the acceleration input device, and a speed-fixing mode in which the boat cruises at a fixed speed determined when a speed-fixing controller is operated, the system further comprising a planing condition determination module configured to determine whether the hull is at a stage of planing, wherein the mode selection module is also configured to prohibit the driving mode from switching to the speed-fixing mode if the planing condition determination module determines that the hull is not at the stage of planing, and wherein the mode selection module is configured to permit switching of the driving mode to the speed-fixing mode if the planing condition determination module determines that the hull is at the stage of planing.

12. The operation control system for a planing boat according to claim 11, wherein the planing condition determination module is configured to determine that the hull is not at the stage of planing if an engine speed or cruising speed is kept lower than a preset value for a predetermined time period.

13. The operation control system for a planing boat according to claim 11, wherein the planing condition determination module is configured to determine that the hull is not at the stage of planing if a moving average obtained based on the engine speed is kept lower than a preset value for a predetermined time period.

14. The operation control system for a planing boat according to claim 11, wherein a speed-limiting mode is provided as an option to control the engine speed so as not to exceed the preset value, and the mode selection means permits the driving mode to switch to the speed-limiting mode if the normal operation mode has been selected, and the mode selection means prohibits the driving mode from switching to the speed-fixing mode if the speed-limiting mode has been selected.

15. The operation control system for a planing boat according to claim 11, further comprising a propulsion unit driven by the engine and a forward/reverse drive shift device configured to change the direction of thrust generated by a propulsion unit to either forward or reverse direction, wherein the mode selection module is configured to permit the driving mode to switch to the speed-fixing mode if the forward/reverse drive shift device has been shifted to a forward drive position, and wherein the mode selection module is configured to prohibit the driving mode from switching to the speed-fixing mode if the forward/reverse drive shift device has been shifted to a reverse drive position.

16. The operation control system for a planing boat according to claim 11, wherein the mode selection module is configured to maintain the speed-fixing mode if the speed-fixing mode has been selected and if the displacement of the acceleration input device is equal to or greater than a preset value.

17. The operation control system for a planing boat according to claim 16, wherein the mode selection module is configured to clear the speed-fixing mode to automatically switch to the normal operation mode if the speed-fixing mode has been selected and if the displacement of the acceleration input device is lower than the preset value.

18. The operation control system for a planing boat according to claim 11, further comprising an anomaly detecting module configured to detect an anomaly in at least any one of engine operation and all detecting modules, wherein the mode selection module prohibits the driving mode from switching to the speed-fixing mode if an anomaly is detected.

19. The operation control system for a planing boat according to claim 11, further comprising an abnormal operation detecting module configured to for detect an abnormal operated state of the speed-fixing controller, wherein the mode selection module prohibits the driving mode from switching to the speed-fixing mode if the abnormal operated state is detected.

20. The operation control system for a planing boat according to claim 11, further comprising a speed adjustment module configured to increase and decrease the cruising speed gradually by small degrees, in accordance with input from a driver when the speed-fixing mode has been selected.

* * * * *

UNITED STATES PATENT AND TRADEMARK OFFICE

CERTIFICATE OF CORRECTION

PATENT NO. : 7,201,620 B2
APPLICATION NO. : 11/336711
DATED : April 10, 2007
INVENTOR(S) : Yoshimasa Kinoshita et al.

It is certified that error appears in the above-identified patent and that said Letters Patent is hereby corrected as shown below:

Title Page; item (56);

At page 2, column 2 (Other Publications), line 1, please delete "11/083,256" and insert -- 11/082,256 --, therefor.

At column 2 (Other Publications), line 2, please delete "2006-057026A1" and insert -- 2006-0157026A1 --, therefor.

At column 2 (Other Publications), line 5, please delete "a" and insert -- as --, therefor.

At column 2 (Other Publications), line 8, please delete "a" and insert -- as --, therefor.

At column 2 (Other Publications), line 12, please delete "2006-004502A1" and insert -- 2006-0004502A1 --, therefor.

At column 2 (Other Publications), line 24, please delete "Appl. No.7,037,147" and insert -- Patent No. 7,037,147 --, therefor.

At column 2 (Other Publications), line 31, please delete "No.10/872,013" and insert -- No. 10/872,013 --, therefor. (Consider Space)

At column 12, line 14, in claim 19, before "detect" please delete "for".

Signed and Sealed this

Twelfth Day of August, 2008

JON W. DUDAS
*Director of the United States Patent and Trademark Office*